US010148040B2

(12) United States Patent
Chien et al.

(10) Patent No.: US 10,148,040 B2
(45) Date of Patent: Dec. 4, 2018

(54) ELECTRICAL PLUG CONNECTOR

(71) Applicant: ADVANCED-CONNECTEK INC., New Taipei (TW)

(72) Inventors: Min-Lung Chien, New Taipei (TW); Ming-Yung Chang, New Taipei (TW); Mao-Sheng Chen, New Taipei (TW); Cheng-Che Tsai, New Taipei (TW); Ling-Tai Liu, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 15/949,440

(22) Filed: Apr. 10, 2018

(65) Prior Publication Data

US 2018/0294604 A1 Oct. 11, 2018

(30) Foreign Application Priority Data

Apr. 11, 2017 (CN) ..... 2017 1 0231681

(51) Int. Cl.

| | |
|---|---|
| ***H01R 13/648*** | (2006.01) |
| ***H01R 13/6581*** | (2011.01) |
| ***H01R 13/6582*** | (2011.01) |
| ***H01R 13/41*** | (2006.01) |
| ***H01R 24/62*** | (2011.01) |

(Continued)

(52) U.S. Cl.

CPC ..... *H01R 13/6581* (2013.01); *H01R 13/41* (2013.01); *H01R 13/516* (2013.01); *H01R 13/6582* (2013.01); *H01R 24/62* (2013.01); *H01R 2107/00* (2013.01)

(58) Field of Classification Search

CPC ..... H01R 13/6581; H01R 13/516; H01R 13/6582; H01R 13/41; H01R 24/62; H01R 2107/00

USPC ..... 439/607.55, 108, 660, 607.35, 607.4, 439/607.09, 607.36

See application file for complete search history.

(56) References Cited

U.S. PATENT DOCUMENTS 8,882,540 B2 * 11/2014 Yen ..... H01R 27/00 439/489
8,968,031 B2 * 3/2015 Simmel ..... H01R 13/659 439/660
9,525,241 B1 * 12/2016 Su ..... H01R 13/6581

(Continued)

*Primary Examiner* — Abdullah Riyami
*Assistant Examiner* — Nelson R Burgos-Guntin
(74) *Attorney, Agent, or Firm* — Muncy, Geissler, Olds & Lowe, P.C.

(57) ABSTRACT

An electrical plug connector includes an insulated housing received in a metallic shell, first and second terminal modules respectively above and below the insulated housing, and abutting plates (EMI (Electro-Magnetic Interference) plates). Each abutting plate (EMI plate) is between the metallic shell and the insulated housing. Each abutting plate (EMI plate) includes a main body and elastic arms outwardly extending from the main body. Each elastic arm includes a terminal contact portion and a shell contact portion. The terminal contact portion is extending toward a corresponding recessed hole of the insulated housing and contacts one or more first ground terminal of the first terminal module or one or more second ground terminal of the second terminal module. The shell contact portion contacts an inner surface of the metallic shell. Therefore, the high frequency features of the connector can be optimized effectively and resonant problems of the connector can be improved.

11 Claims, 10 Drawing Sheets

(51) Int. Cl.
*H01R 13/516* (2006.01)
*H01R 107/00* (2006.01)

(56) References Cited

U.S. PATENT DOCUMENTS

| | | | | |
|---|---|---|---|---|
| 9,601,876 | B2 * | 3/2017 | Jiang | H01R 13/6585 |
| 9,647,369 | B2 * | 5/2017 | Tsai | H01R 4/02 |
| 9,843,148 | B2 * | 12/2017 | Little | H01R 24/60 |
| 9,966,693 | B2 * | 5/2018 | Liu | H01R 13/22 |
| 10,020,619 | B2 * | 7/2018 | Zhang | H01R 12/7082 |
| 2015/0255905 | A1 * | 9/2015 | Little | H01R 13/6658 439/78 |
| 2018/0026410 | A1 * | 1/2018 | Tsai | H01R 13/502 439/607.09 |

* cited by examiner

ELECTRICAL PLUG CONNECTOR

CROSS-REFERENCE TO RELATED APPLICATION

This non-provisional application claims priority under 35 U.S.C. § 119(a) to Patent Application No. 201710231681.6 filed in China, P.R.C. on Apr. 11, 2017, the entire contents of which are hereby incorporated by reference.

FIELD OF THE INVENTION

The instant disclosure relates to an electrical connector, and more particular to an electrical plug connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

The appearance, the structure, the contact ways of terminals, the number of terminals, the pitches between terminals (the distances between the terminals), and the pin assignment of terminals of a conventional USB type-C electrical connector are totally different from those of a conventional USB electrical connector. A conventional USB type-C electrical plug connector includes a plastic core, upper and lower plug terminals held on the plastic core, an outer iron shell circularly enclosing the plastic core, and abutting plates held on the plastic core.

SUMMARY OF THE INVENTION

In general, the abutting plates (EMI (Electro-Magnetic Interference) plates) on the insulated plastic core of the conventional USB type-C electrical plug connector are provided for being in contact with a mating electrical receptacle connector as well as the outer iron shell for preventing electromagnetic interference and retarding noises. As a result, how to use the abutting plates (EMI (Electro-Magnetic Interference) plates) to optimize the high frequency features of the conventional connector and to improve the resonant problems met by the conventional connector are issues to be considered.

In view of this, an embodiment of the instant disclosure provides an electrical plug connector. The electrical plug connector comprises a metallic shell, an insulated housing, a first terminal module, a second terminal module, and a plurality of abutting plates (EMI (Electro-Magnetic Interference) plates). The metallic shell comprises a receiving cavity, and the insulated housing is received in the receiving cavity. The insulated housing comprises a first assembling portion and a second assembling portion corresponding to the first assembling portion. An insertion cavity is formed between the first assembling portion and the second assembling portion. A plurality of terminal grooves is formed on the first assembling portion and the second assembling portion, and the terminal grooves are in communication with the insertion cavity. An opening of the insertion cavity is at one of two sides of the insulated housing, and an assembling recess is recessed from the other side of the insulated housing. A plurality of recessed holes is formed on the first assembling portion and the second assembling portion. The recessed holes are in communication with the assembling recess. The first terminal module comprises a plurality of first plug terminals and a first combining block assembled with the first plug terminals. The first combining block is on the assembling recess. One end of each of the first plug terminals is extending from the insertion cavity toward the corresponding terminal groove of the first assembling portion. The first plug terminals comprise a plurality of first signal terminals, at least one first power terminal, and at least one first ground terminal. The second terminal module comprises a plurality of second plug terminals and a second combining block assembled with the second plug terminals. The second combining block is on the assembling recess and combined with the first combining block. One end of each of the second plug terminals is extending from the insertion cavity toward the corresponding terminal groove of the second assembling portion. The second plug terminals comprise a plurality of second signal terminals, at least one second power terminal, and at least one second ground terminal. The abutting plates (EMI (Electro-Magnetic Interference) plates) are respectively on the first assembling portion and the second assembling portion. Each of the abutting plates (EMI (Electro-Magnetic Interference) plates) comprises a main body and a plurality of elastic arms respectively outwardly extending from a rear portion of the main body. Each of the elastic arms comprises a terminal contact portion and a shell contact portion. The terminal contact portion is extending toward the corresponding recessed hole and in contact with the at least one first ground terminal or the at least one second ground terminal, and the shell contact portion is in contact with an inner surface of the metallic shell.

In one embodiment, each of the terminal contact portions is downwardly extending below the corresponding recessed hole from a rear portion of the corresponding elastic arm, each of the shell contact portions is reversely bent from the corresponding terminal contact portion and upwardly extending above the corresponding recessed hole, and an edge portion of each of the shell contact portions is in contact with the inner surface of the metallic shell.

In one embodiment, after the inner surface of the metallic shell is in contact with the shell contact portions, the terminal contact portions are respectively in contact with the at least one first ground terminal and the at least one second ground terminal.

In one embodiment, the edge portion of each of the shell contact portions is extending out of the corresponding recessed hole for being in contact with the inner surface of the metallic shell.

In one embodiment, each of the shell contact portions is upwardly extending above the corresponding recessed hole from a rear portion of the corresponding elastic arm, and each of the terminal contact portions is reversely bent from the corresponding shell contact portion and downwardly extending below the corresponding recessed hole.

In one embodiment, each of the first plug terminals comprises a first flexible contact portion, a first body portion, and a first tail portion. Each of the first body portions is held in the first combining block, each of the first flexible contact portions is extending forward from the first body portion in the rear-to-front direction and held in the corresponding terminal groove of the first combining block, and each of the first tail portions is extending backward from the first body portion in the front-to-rear direction and extending out of the first combining block. A surface of each of the first body portions is exposed out of a surface of the first combining block and in contact with the terminal contact portion.

In one embodiment, each of the second plug terminals comprises a second flexible contact portion, a second body portion, and a second tail portion. Each of the second body portions is held in the second combining block, each of the second flexible contact portions is extending forward from the second body portion in the rear-to-front direction and held in the corresponding terminal groove of the second combining block, and each of the second tail portions is extending backward from the second body portion in the front-to-rear direction and extending out of the second combining block. A surface of each of the second body portions is exposed out of a surface of the second combining block and in contact with the terminal contact portion.

In one embodiment, the electrical plug connector further comprises a plurality of Mylar sheets. Each of the Mylar sheets is between the corresponding abutting plate and the metallic shell.

In one embodiment, each of the abutting plates further comprises a slot, a plurality of abutting portions, and a plurality of hook portions. The slot is formed on the main body and corresponding to the terminal grooves. Each of the abutting portions is outwardly extending from a front end of the main body toward the insertion cavity. The hook portions are extending and bent from two sides of the main body and respectively engaged with the first assembling portion and the second assembling portion.

As above, the elastic arms are extending from the rear portion of the abutting plates, and each of the elastic arms comprises a terminal contact portion and a shell contact portion. The terminal contact portions are provided for being in contact with the ground terminals of the plug terminals. The shell contact portions are provided for being in contact with the metallic shell. The shell contact portions are in contact with the metallic shell for performing conduction and grounding through the contacts between the terminal contact portions and the ground terminals of the plug terminals in a short-distance manner. Therefore, the high frequency features of the connector can be optimized effectively and the resonant problems of the connector can be improved.

Furthermore, the first plug terminals and the second plug terminals are arranged upside down, and the pin-assignment of the first flexible contact portions is left-right reversal with respect to that of the second flexible contact portions. Accordingly, the electrical plug connector can have a 180 degree symmetrical, dual or double orientation design and pin assignments which enables the electrical plug connector to be mated with a corresponding receptacle connector in either of two intuitive orientations, i.e. in either upside-up or upside-down directions. Therefore, when the electrical plug connector is inserted into the electrical receptacle connector with a first orientation, the first flexible contact portions are in contact with upper-row receptacle terminals of the electrical receptacle connector. Conversely, when the electrical plug connector is inserted into the electrical receptacle connector with a second orientation, the second flexible contact portions are in contact with the upper-row receptacle terminals of the electrical receptacle connector. Note that, the inserting orientation of the electrical plug connector is not limited by the electrical receptacle connector.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
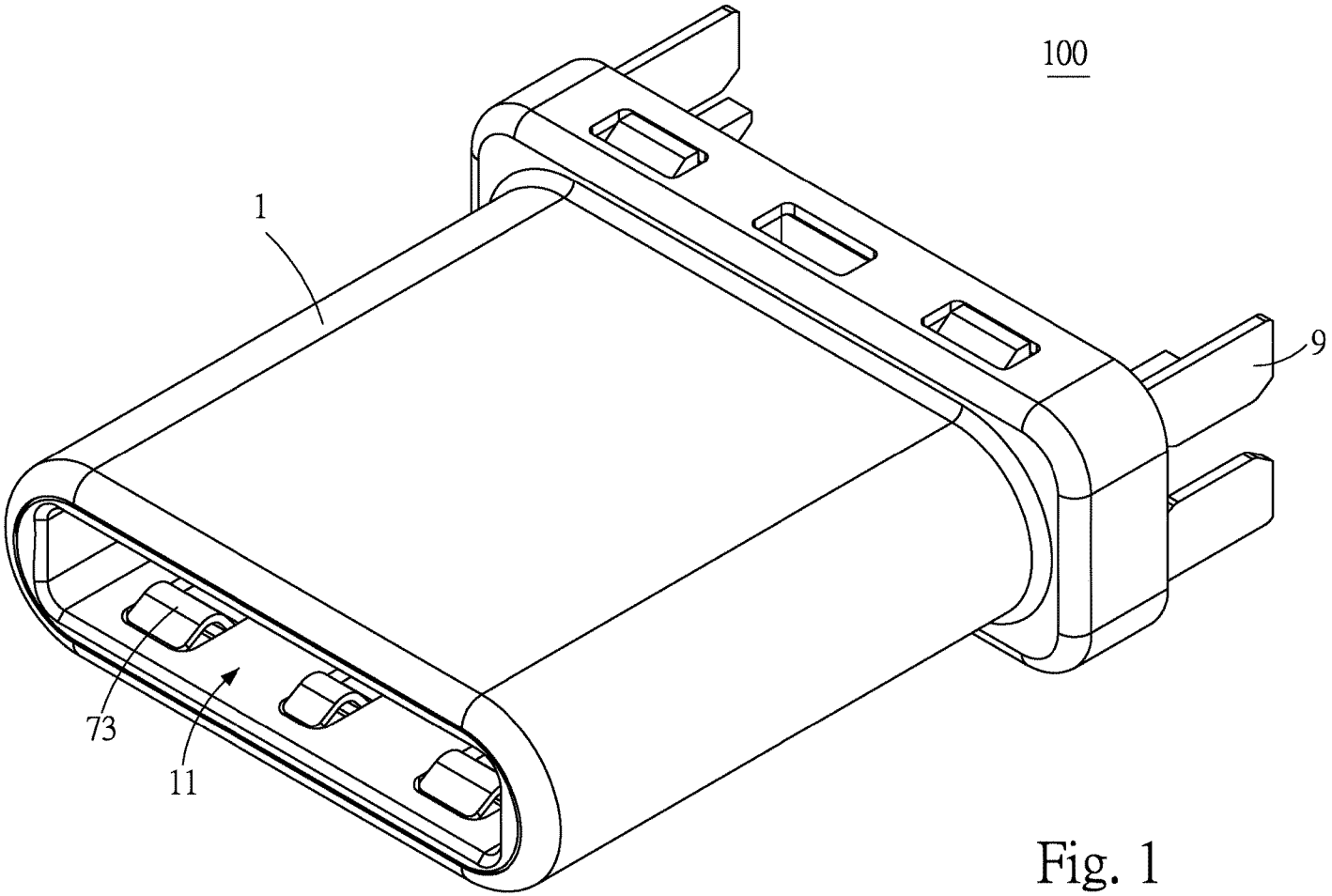
FIG. 1 illustrates a perspective view of an electrical plug connector according to a first embodiment of the instant disclosure.
Figure 2:
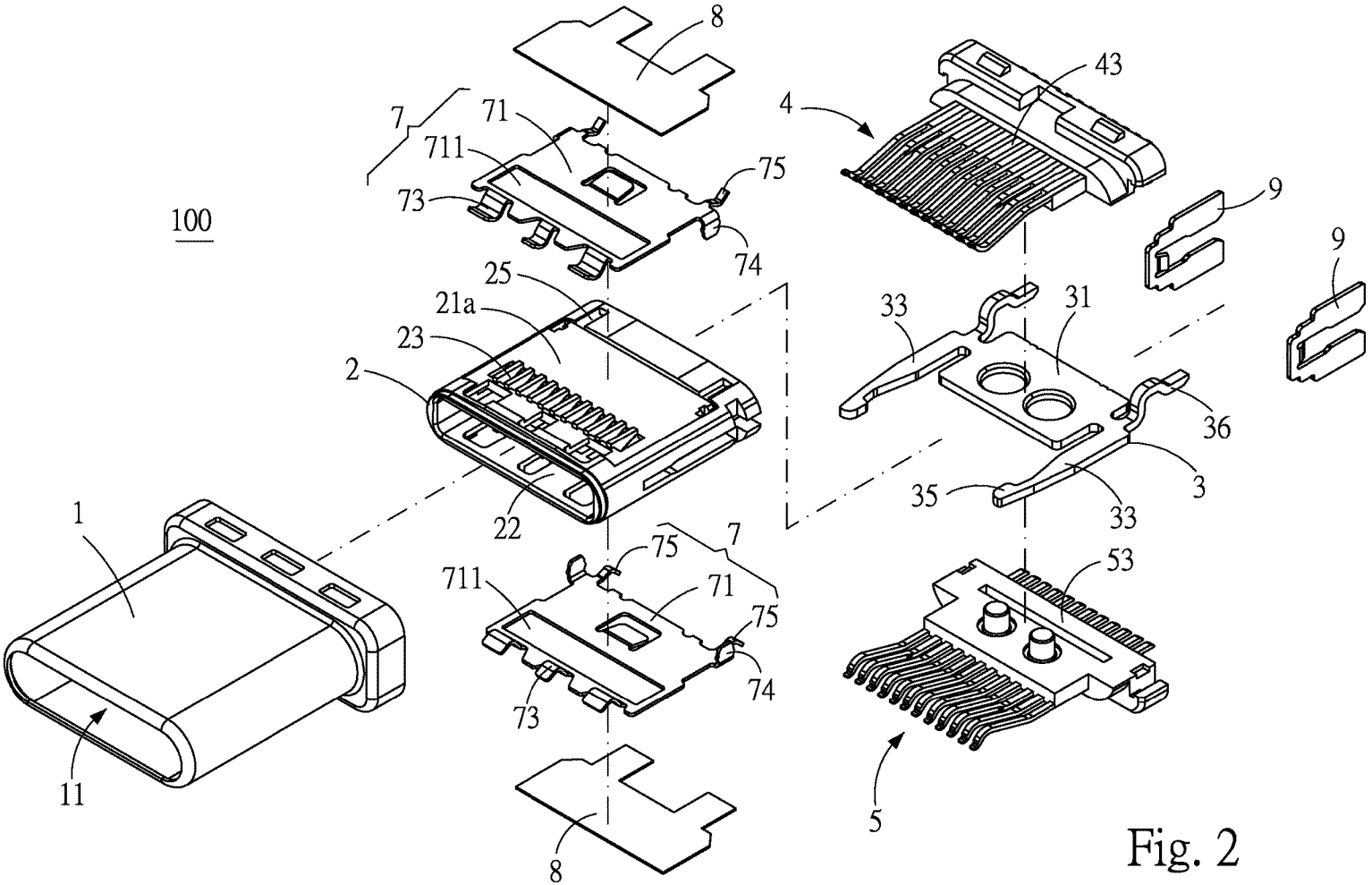
FIG. 2 illustrates an exploded view of the electrical plug connector.
Figure 3:
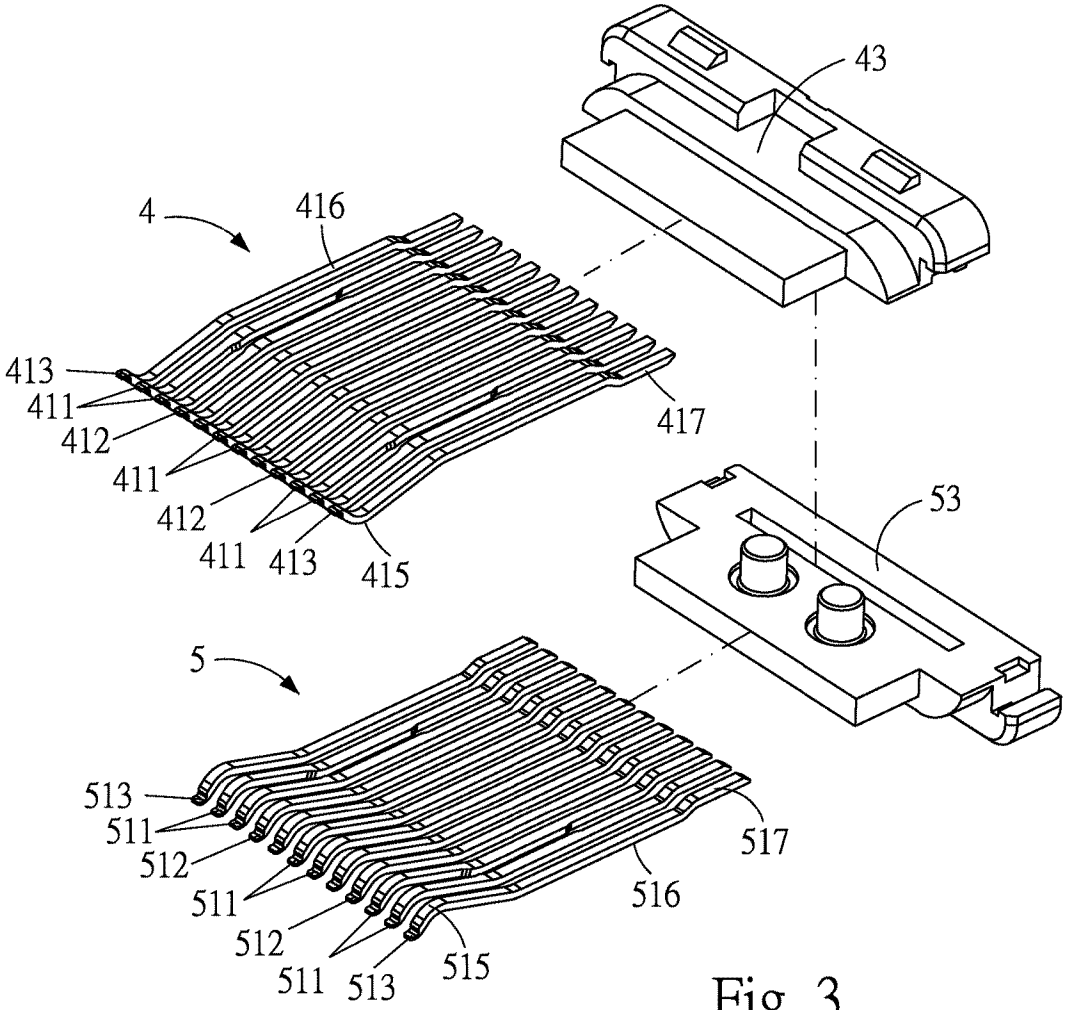
FIG. 3 illustrates an exploded view of a first terminal module and a second terminal module of the electrical plug connector.
Figure 4:
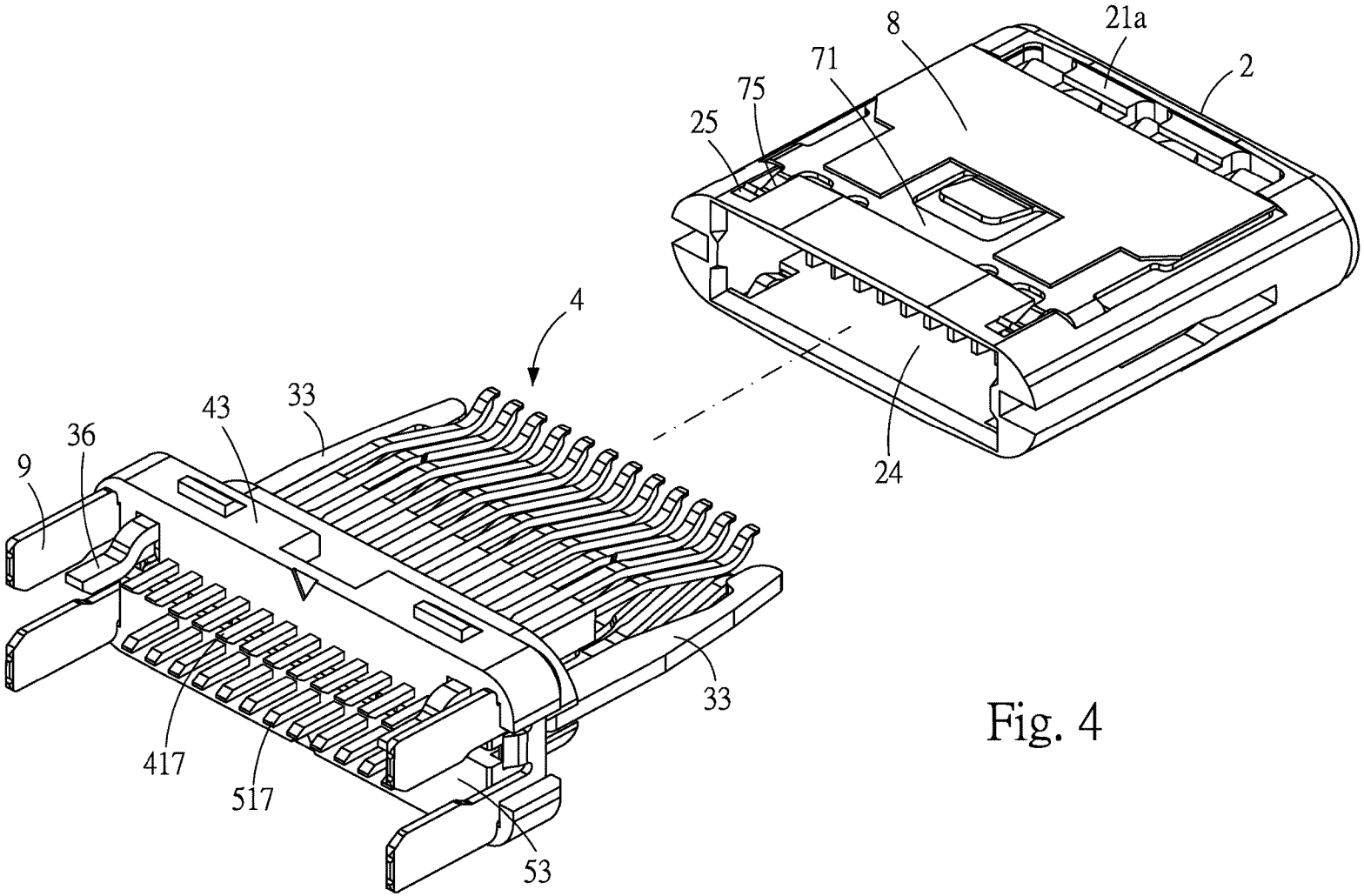
FIG. 4 illustrates a partial exploded view of the electrical plug connector.

Please refer to FIGS. 1 to 4, illustrating an electrical plug connector of a first embodiment of the instant disclosure. FIG. 1 illustrates a perspective view thereof, FIG. 2 illustrates an exploded view thereof, FIG. 3 illustrates an exploded view of a first terminal module 4 and a second terminal module 5 thereof, and FIG. 4 illustrates a partial exploded view thereof. In this embodiment, the electrical plug connector 100 can provide a reversible or dual orientation USB Type-C connector interface and pin assignments, i.e., a USB Type-C plug connector. In this embodiment, the electrical plug connector 100 comprises a metallic shell 1, an insulated housing 2, a first terminal module 4, a second terminal module 5, and a plurality of abutting plates 7. The abutting plates are EMI (Electro-Magnetic Interference) plates.

Please refer to FIGS. 1 and 2. In this embodiment, the metallic shell 1 is a hollowed shell formed by deep drawing techniques. In other words, the metallic shell 1 is a unitary member and is a seamless shell. The metallic shell 1 has a beautiful appearance and improved structural strength. In addition, the metallic shell 1 has a receiving cavity 11 therein. The metallic shell 1 encloses the insulated housing 2. In other words, the insulated housing 2 is received in the receiving cavity 11. In this embodiment, the metallic shell 1 is a unitary member, but embodiments are not limited thereto. In some embodiments, several pieces may be bent to form the metallic shell 1.

Figure 7:
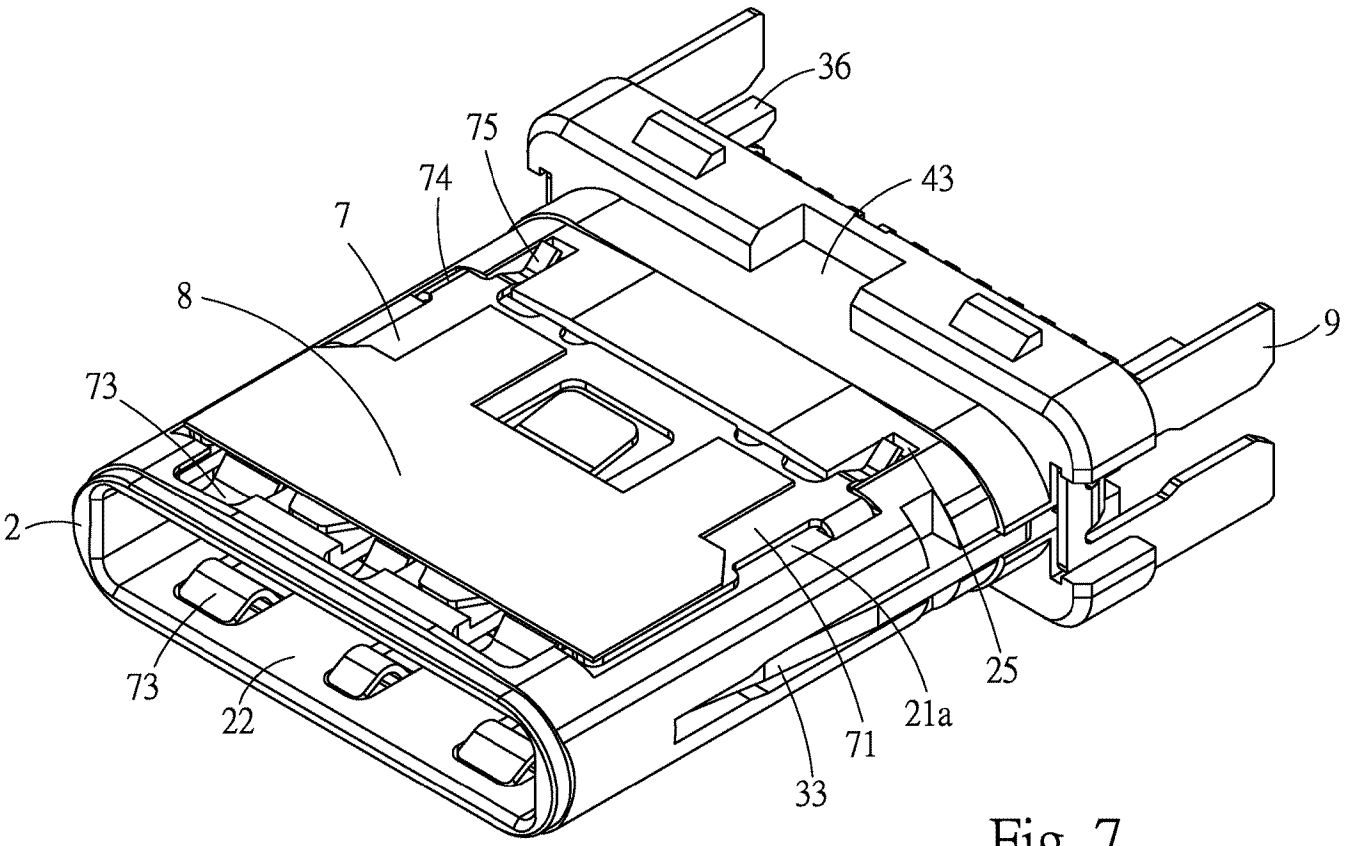
FIG. 7 illustrates a partial perspective view of the electrical plug connector.
Figure 8:
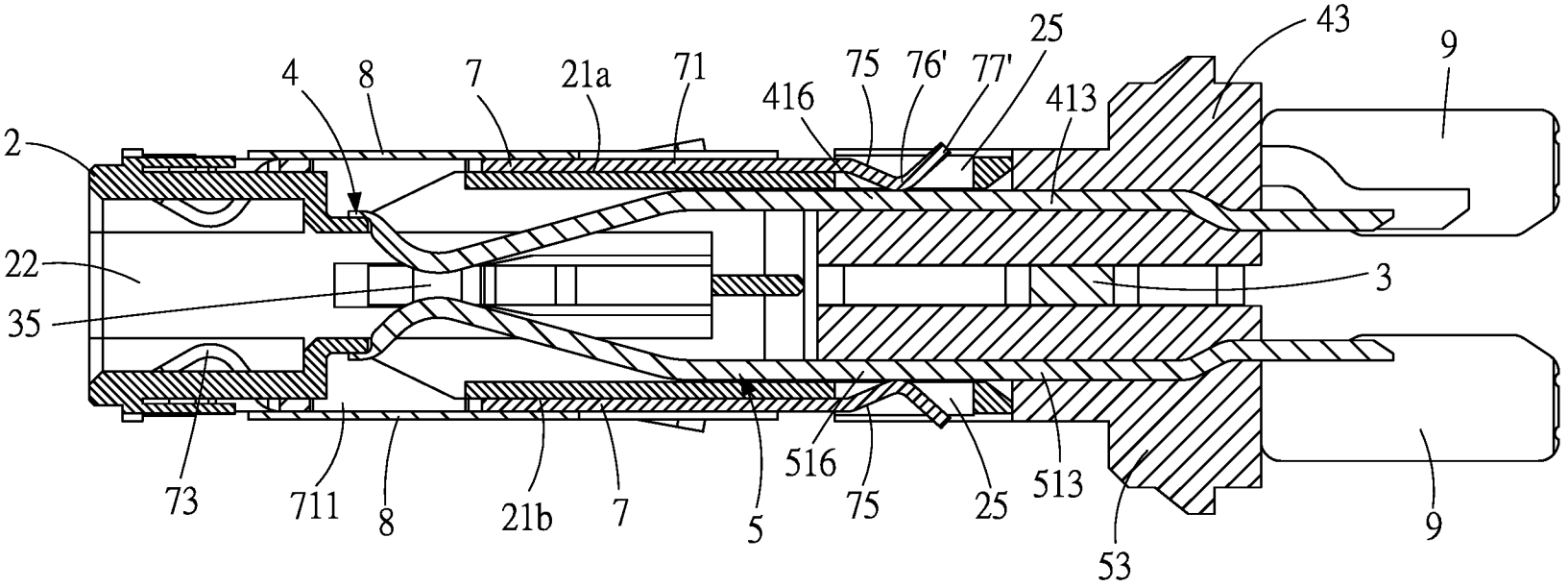
FIG. 8 illustrates a partial lateral-sectional view of the electrical plug connector.

Please refer to FIGS. 2, 4, 7, and 8. FIG. 7 illustrates a partial perspective view of the electrical plug connector, and FIG. 8 illustrates a partial lateral-sectional view of the electrical plug connector. In this embodiment, the insulated housing 2 is a tubular elongated plate. The upper portion of the insulated housing 2 is symmetrical to the lower portion of the insulated housing 2, and the left portion of the insulated housing 2 is symmetrical to the right portion of the insulated housing 2. The insulated housing 2 comprises a first assembling portion 21*a*, a second assembling portion 21*b*, an insertion cavity 22, a plurality of terminal grooves 23, and an assembling recess 24. Wherein, the insulated housing 2 comprises the first assembling portion 21*a* (which may be an upper portion or a lower portion of the insulated housing 2) and the second assembling portion 21*b* (which may be an upper portion or a lower portion of the insulated housing 2) corresponding to the first assembling portion 21*a*. The insertion cavity 22 is between the first assembling portion 21*a* and the second assembling portion 21*b*. The terminal grooves 23 are formed on the first assembling portion 21*a* and the second assembling portion 21*b* and in communication with the insertion cavity 22.

Please refer to FIGS. 2, 4, 7, and 8. An opening of the insertion cavity 22 is formed on a front portion of the insulated housing 2 for mating with an electrical receptacle connector. The assembling recess 24 is recessed from a rear portion of the insulated housing 2. In other words, a hollowed assembling region is at the rear portion of the insulated housing 2 for assembling with the first terminal module 4 and the second terminal module 5. Moreover, the insertion cavity 22 is between the first assembling portion 21*a* and the second assembling portion 21*b*, and each of the terminal grooves 23 is an elongate groove. Each of the terminal grooves 23 is arranged on the first assembling portion 21*a* and the second assembling portion 21*b* along a length direction, and each of the terminal grooves 23 are defined through the first assembling portion 21*a* and the second assembling portion 21*b* and respectively in communication with the insertion cavity 22.

Please refer to FIGS. 2, 4, 7, and 8. In this embodiment, the first terminal module 4 comprises a plurality of first plug terminals 41 and a first combining block 43 assembled with the first plug terminals 41. The first combining block 43 is held in the assembling recess 24. One end of each of the first plug terminals 41 is extending from the insertion cavity 22 toward the corresponding terminal groove 23 of the first assembling portion 21*a*. The first combining block 43 is formed with the first body portions 416 of the first plug terminals 41 and positioned on one of two surfaces of a central combining plate 31.

Please refer to FIGS. 2, 3, 4, and 8. In this embodiment, the second terminal module 5 comprises a plurality of second plug terminals 51 and a second combining block 53 assembled with the second plug terminals 51. The second combining block 53 is held in the assembling recess 24 and assembled with the first combining block 43. One end of each of the second plug terminals 51 is extending from the insertion cavity 22 toward the corresponding terminal groove 23 of the second assembling portion 21*b*. The second combining block 53 is formed with the second body portions 516 of the second plug terminals 51 and positioned on the other surface of the central combining plate 31.

Please refer to FIGS. 2, 3, 4, and 8. In this embodiment, the first plug terminals 41 comprise a plurality of signal terminals 411, at least one power terminal 412, and at least one ground terminal 413. The first plug terminals 41 are held in the insulated housing 2 and disposed upon a lower surface (i.e., a first mating surface) of the first assembling portion 21*a*. From a front view of the first plug terminals 41, the first plug terminals 41 comprise, from right to left, a ground terminal 413 (Gnd), a first pair high-speed signal terminals (TX1+-, differential signal terminals), a power terminal 412 (Power/VBUS), a first function detection terminal (CC1, a terminal for inserting orientation detection of the connector and for cable recognition), a pair of low-speed signal terminals (D+-, differential signal terminals), a first reserved terminal, another power terminal 412 (Power/VBUS), a second pair of high-speed signal terminals (RX2+-, differential signal terminals), and another ground terminal 413 (Gnd).

Please refer to FIGS. 2, 3, 4, and 8. Each of the first plug terminals 41 comprises a first flexible contact portion 415, a first body portion 416, and a first tail portion 417. In this embodiment, the first body portions 416 are held in the first combining block 43. The first flexible contact portion 415 is extending forward from the first body portion 416 in the rear-to-front direction and held in the terminal groove 23 of the first assembling portion 21*a*, and the first tail portion 417 is extending backward from the first body portion 416 in the front-to-rear direction and protruding out of the first combining block 43. The first flexible contact portion 415 has a curved profile. The first plug terminals 41 are extending toward the insertion cavity 22 for transmitting first signals (i.e., USB 3.0 signals).

Please refer to FIGS. 2, 3, 4, and 8. In this embodiment, the second plug terminals 51 comprise a plurality of signal terminals 511, at least one power terminal 512, and at least one ground terminal 513. The second plug terminals 51 are held in the insulated housing 2 and disposed upon an upper surface (i.e., a second mating surface) of the second assembling portion 21*b*. From a front view of the second plug terminals 51, the second plug terminals 51 comprise, from left to right, a ground terminal 513 (Gnd), a first pair high-speed signal terminals (TX2+-, differential signal terminals), a power terminal 512 (Power/VBUS), a second function detection terminal (CC2, a terminal for inserting orientation detection of the connector and for cable recognition), a pair of low-speed signal terminals (D+-, differential signal terminals), a second reserved terminal, another power terminal 512 (Power/VBUS), a second pair of high-speed signal terminals (RX1+-, differential signal terminals), and another ground terminal 513 (Gnd).

Please refer to FIGS. 2, 3, 4, and 8. Each of the second plug terminals 51 comprises a second flexible contact portion 515, a second body portion 516, and a second tail portion 517. The second body portions 516 are held in the second combining block 53. The second flexible contact portion 515 is extending forward from the second body portion 516 in the rear-to-front direction and held in the terminal groove 23 of the second assembling portion 21*b*, and the second tail portion 517 is extending backward from the second body portion 516 in the front-to-rear direction and protruding out of the second combining block 53. The second flexible contact portion 515 has a curved profile, and the second flexible contact portions 515 correspond to the first flexible contact portions 415. In other words, for example, the first flexible contact portion 415 may be curved inward but the corresponding second flexible contact portion 515 may be curved outward. Each of the first tail portions 417 and the corresponding second tail portion 517 form a clamp for holding and contacting a circuit board. Moreover, the second plug terminals 51 are extending toward the insertion cavity 22 for transmitting second signals (i.e., USB 3.0 signals).

Please refer to FIGS. 2, 3, 4, and 8. In this embodiment, the first plug terminals 41 and the second plug terminals 51 are respectively held on the first mating surface of the first assembling portion 21*a* and the second mating surface of the second assembling portion 21*b*. Moreover, pin-assignments of the first plug terminals 41 and the second plug terminals 51 are point-symmetrical with a central point of the receiving cavity 11 as the symmetrical center. In other words, pin-assignments of the first plug terminals 41 and the second plug terminals 51 have 180-degree symmetrical design with respect to the central point of the receiving cavity 11 as the symmetrical center. The dual or double orientation design enables the electrical plug connector 100 to be inserted into an electrical receptacle connector in either of two intuitive orientations, i.e., in either upside-up or upside-down directions. Here, point-symmetry means that after the first plug terminals 41 (or the second plug terminals 51), are rotated by 180 degrees with the symmetrical center as the rotating center, the first plug terminals 41 and the second plug terminals 51 are overlapped. That is, the rotated first plug terminals 41 are arranged at the position of the original second plug terminals 51, and the rotated second plug terminals 51 are arranged at the position of the original first plug terminals 41.

In other words, the first plug terminals 41 and the second plug terminals 51 are arranged upside down, and the pin assignments of the first plug terminals 41 are left-right reversal with respect to that of the second plug terminals 51. Therefore, the electrical plug connector 100 may be inserted into an electrical receptacle connector with a first orientation where the first mating surface is facing down, for transmitting first signals. Conversely, the electrical plug connector 100 may also be inserted into the electrical receptacle connector with a second orientation where the first mating surface is facing up, for transmitting second signals. Furthermore, the specification for transmitting the first signals is conformed to the specification for transmitting the second signals. Note that, the inserting orientation of the electrical plug connector 100 is not limited by the electrical receptacle connector. Furthermore, in this embodiment, the first flexible contact portions 415 correspond to the second flexible contact portions 515.

Please refer to FIGS. 2, 3, 4, and 8. In this embodiment, the surface of each of the first body portions 416 is exposed from the surface of the first combining block 43, and the surface of each of the second body portions 516 is exposed from the surface of the second combining block 53, but embodiments are not limited thereto. In one embodiment, the surface of the first body portion 416 of the at least one ground terminal 413 is exposed from the surface of the first combining block 43, and the surface of the second body portion 516 of the at least one ground terminal 513 is exposed from the surface of the second combining block 53. Therefore, the terminal contact portions 76' of the abutting plates (EMI (Electro-Magnetic Interference) plates) 7 are respectively in contact with the first body portion 416 of the at least one ground terminal 413 and the second body portion 516 of the at least one ground terminal 513, and the shell contact portions 77' of the abutting plates (EMI (Electro-Magnetic Interference) plates) 7 are in contact with an inner surface of the metallic shell 1 for conduction.

Please refer to FIGS. 2, 3, 4, and 8. In this embodiment, the surfaces of the first body portions 416 are flushed with the surface of the first combining block 43, and the surfaces of the second body portions 516 are flushed with the surface of the second combining block 53. In this embodiment, the surfaces of the first body portions 416 and the surface of the first combining block 43 are at a same horizontal plane, and the surfaces of the second body portions 516 and the surface of the second combining block 53 are at a same horizontal plane, but embodiments are not limited thereto. In one embodiment, the surfaces of the first body portions 416 and the surface of the first combining block 43 may be at different horizontal planes and not flushed with each other, and the surfaces of the second body portions 516 and the surface of the second combining block 53 may be at different horizontal planes and not flushed with each other.

Figure 5:
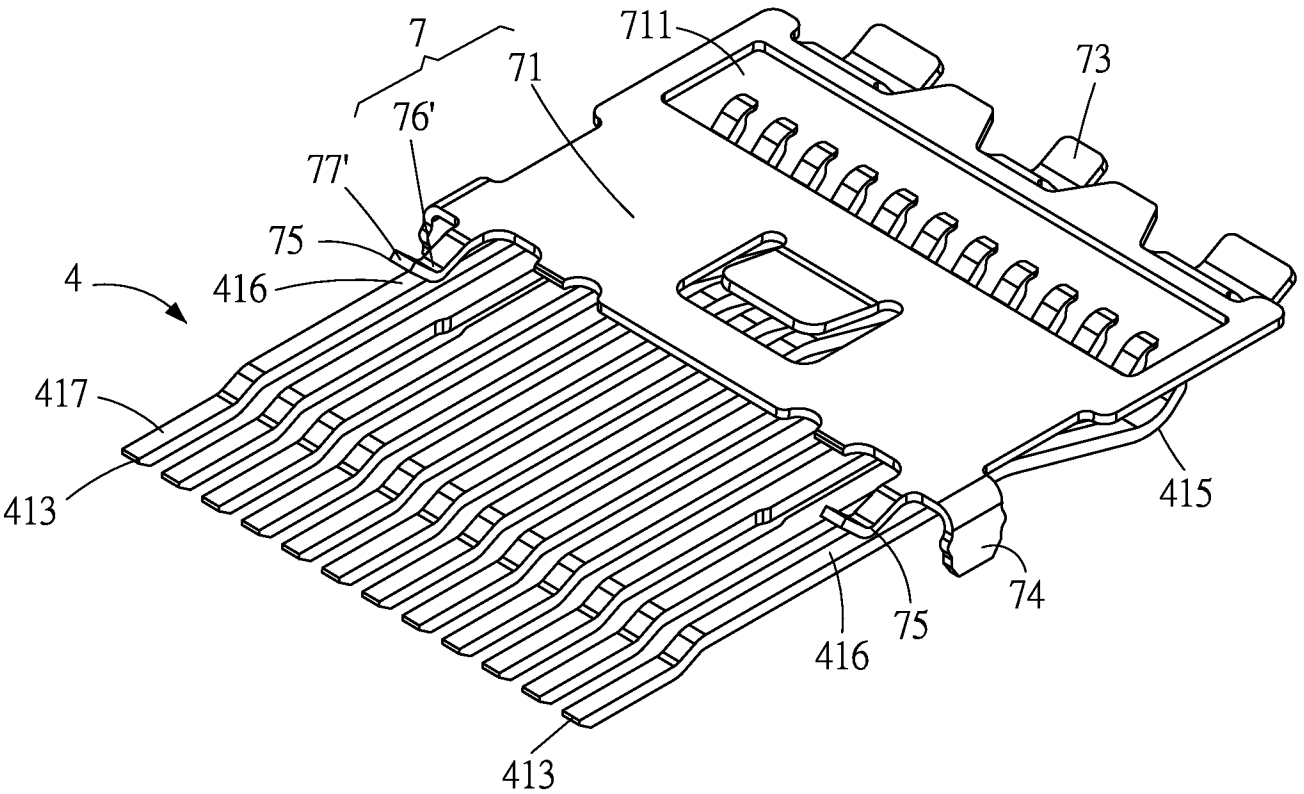
FIG. 5 illustrates a perspective view of the abutting plates and the first plug terminals of the electrical plug connector.
Figure 6:
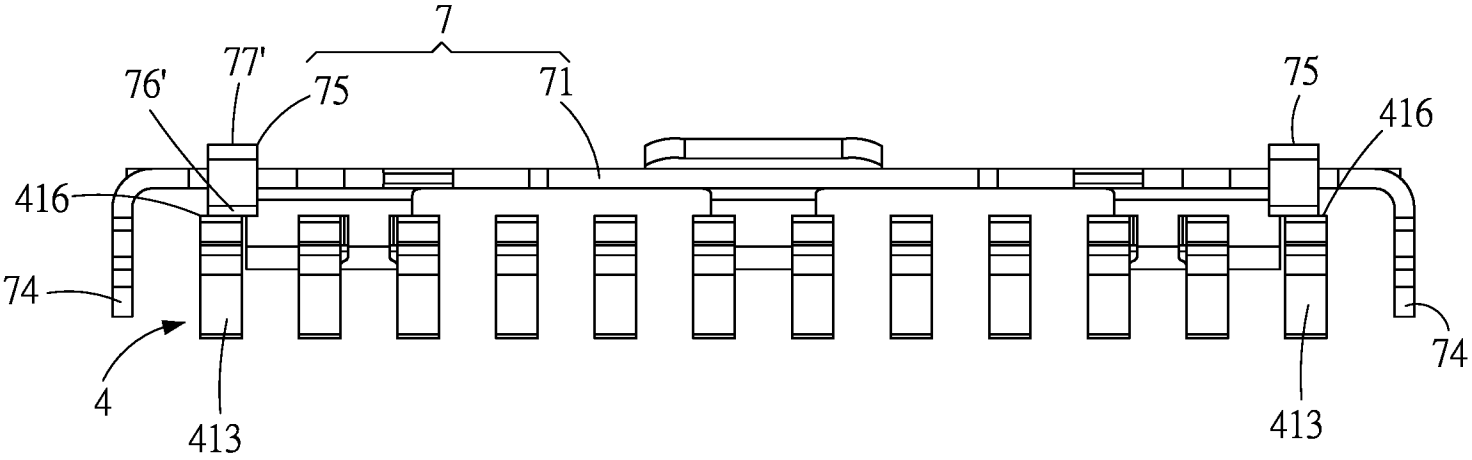
FIG. 6 illustrates a front view of the abutting plates and the first plug terminals of the electrical plug connector.

Please refer to FIGS. 2, 5, and 6. In this embodiment, the width of each of the elastic arms 75 of each of the abutting plates (EMI (Electro-Magnetic Interference) plates) 7 is greater than the width of the ground terminal 413 or the width of the ground terminal 513. Therefore, when there are size errors between components of the connector, each of the elastic arms 75 is ensured to be in contact with the ground terminal 413 of the first plug terminals 41 and the ground terminal 513 of the second plug terminals 51.

Figure 9:
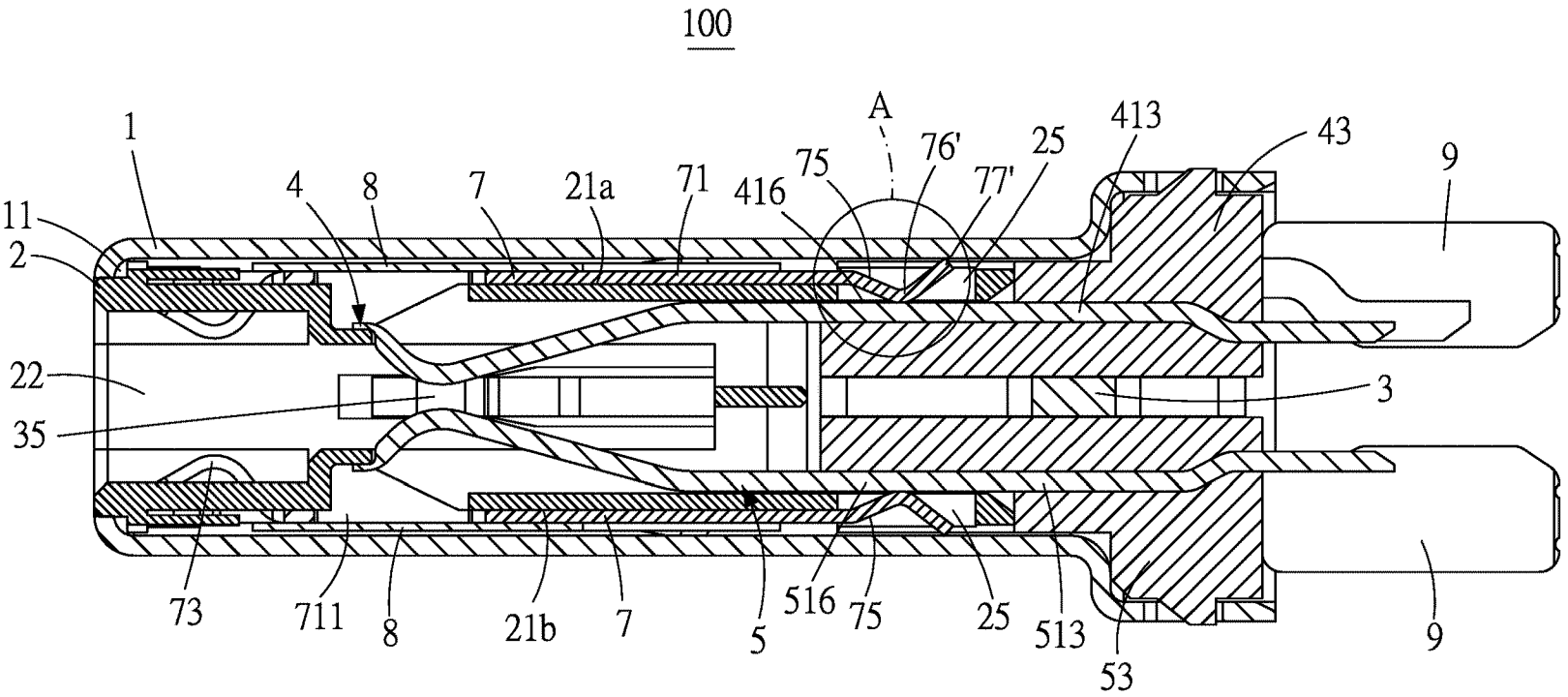
FIG. 9 illustrates a sectional view of the electrical plug connector with the metallic shell.

Please refer to FIGS. 2, 4, 8, and 9. FIG. 9 illustrates a sectional view of the electrical plug connector with the metallic shell 1. In this embodiment, after the inner surface of the metallic shell 1 is in contact with the shell contact portions 77' of the abutting plates (EMI (Electro-Magnetic Interference) plates) 7, the terminal contact portions 76' of the abutting plates (EMI (Electro-Magnetic Interference) plates) 7 are respectively in contact with the at least one ground terminal 413 of the first plug terminals 41 and the at least one ground terminal 513 of the second plug terminals 51. When the metallic shell 1 is not assembled with the insulated housing 2, the terminal contact portions 76' are not in contact with the at least one ground terminal 413 of the first plug terminals 41 and the at least one ground terminal 513 of the second plug terminals 51.

When the metallic shell 1 is assembled out of the insulated housing 2, the inner surface of the metallic shell 1 is in contact with and presses against the shell contact portions 77' of the abutting plates 7 (EMI (Electro-Magnetic Interference) plates), and the terminal contact portions 76' are moved to be in contact with the at least one ground terminal 413 of the first plug terminals 41 and the at least one ground terminal 513 of the second plug terminals 51. Please refer to FIGS. 8 and 9. The distance between the unmoved terminal contact portions 76' of an upper abutting plate (EMI (Electro-Magnetic Interference) plates) 7 and the unmoved terminal contact portions 76' of a lower abutting plate (EMI (Electro-Magnetic Interference) plates) 7 is less than the distance between the moved terminal contact portions 76' of the upper abutting plate (EMI (Electro-Magnetic Interference) plates) 7 and the moved terminal contact portions 76' of the lower abutting plate (EMI (Electro-Magnetic Interference) plates) 7. Hence, as shown in FIGS. 8 and 9, when the first terminal module 4 and the second terminal module 5 are assembled in the insulated housing 2, the first flexible contact portions 415 of the first plug terminals 41 and the second flexible contact portions 515 of the second plug terminals 51 are not impacted with the terminal contact portions 76' of the upper and lower abutting plates (EMI (Electro-Magnetic Interference) plates) 7. Therefore, the first terminal module 4 and the second terminal module 5 can be assembled with the insulated housing 2 conveniently.

Please refer to FIGS. 2 and 4 and FIGS. 7 to 9. The edge portion of each of the shell contact portions 77' is extending out of the corresponding recessed hole 25. When the metallic shell 1 is assembled out of the insulated housing 2, the inner surface of the metallic shell 1 is in contact with the shell contact portions 77' of the abutting plates (EMI (Electro-Magnetic Interference) plates) 7. For each of the abutting plates (EMI (Electro-Magnetic Interference) plates) 7, the terminal contact portion 76' and the shell contact portion 77' form a V-shape profile. Hence, when the metallic shell 1 is assembled out of the insulated housing 2, the metallic shell 1 pushes the shell contact portions 77' to move toward the recessed holes 25. Therefore, the metallic shell 1 can be assembled with the insulated housing 2 conveniently, and assembling the metallic shell 1 with the insulated housing 2 would not be interfered by the shell contact portions 77'.

Please refer to FIGS. 2, 4, 7, and 9. Each of the abutting plates (EMI (Electro-Magnetic Interference) plates) 7 further comprises a slot 711, a plurality of abutting portions 73, and a plurality of hook portions 74. The slot 711 is formed on the main body 71 and corresponding to the terminal grooves 23. Each of the abutting portions 73 is outwardly extending from a front end of the main body 71 toward the insertion cavity 22. The hook portions 74 are extending and bent from two sides of the main body 71 and respectively engaged with the first assembling portion 21*a* and the second assembling portion 21*b*.

Please refer to FIGS. 2, 4, 7, and 9. In one embodiment, the electrical plug connector 100 further comprises a plurality of Mylar sheets 8. Each of the Mylar sheets 8 is between the corresponding abutting plate (EMI (Electro-Magnetic Interference) plates) 7 and the metallic shell 1. Therefore, the Mylar sheets 8 prevent the first flexible contact portions 415 and the second flexible contact portions 515 from being in contact with the metallic shell 1.

Please refer to FIGS. 2, 3, 7, and 8. In this embodiment, the electrical plug connector further comprises a grounding plate 3. In this embodiment, the grounding plate 3 is formed by blanking techniques, but embodiments are not limited thereto. In some embodiments, the grounding plate 3 may be formed by stamping techniques. A grounding plate 3 formed by blanking has a better structural strength than a grounding plate 3 formed by stamping. In addition, the grounding plate 3 is on the insulated housing 2. In this embodiment, the grounding plate 3 comprises a central combining plate 31 and a plurality of side arms 33. The central combining plate 31 is a rectangular plate and held in the assembling recess 24. Each of the side arms 33 is an elongate pin structure. The side arms 33 are symmetrical with each other, i.e., a first side arm 33 is mirrored with respect to its corresponding second side arm 33. The side arms 33' are passing through notches at two sides of the insulated housing 2 and extending into the insertion cavity 22.

Please refer to FIGS. 2, 3, 7, and 8. In this embodiment, each of the side arms 33' further comprises an elastic contact portion 35 and a leg 36. Each of the elastic contact portions 35 is formed on a front portion of the corresponding side arm 33 for contacting an electrical receptacle connector. When an electrical receptacle connector is mated with the electrical plug connector 100, the elastic contact portions 35 allow the electrical plug connector 100 to be positioned with the electrical receptacle connector. Each of the legs 36 is outward extending, from a rear portion of the corresponding side arm 33, out of the insulated housing 2. The legs 36 are extending out of the insulated housing 2 to be in contact with a circuit board.

Figure 10:
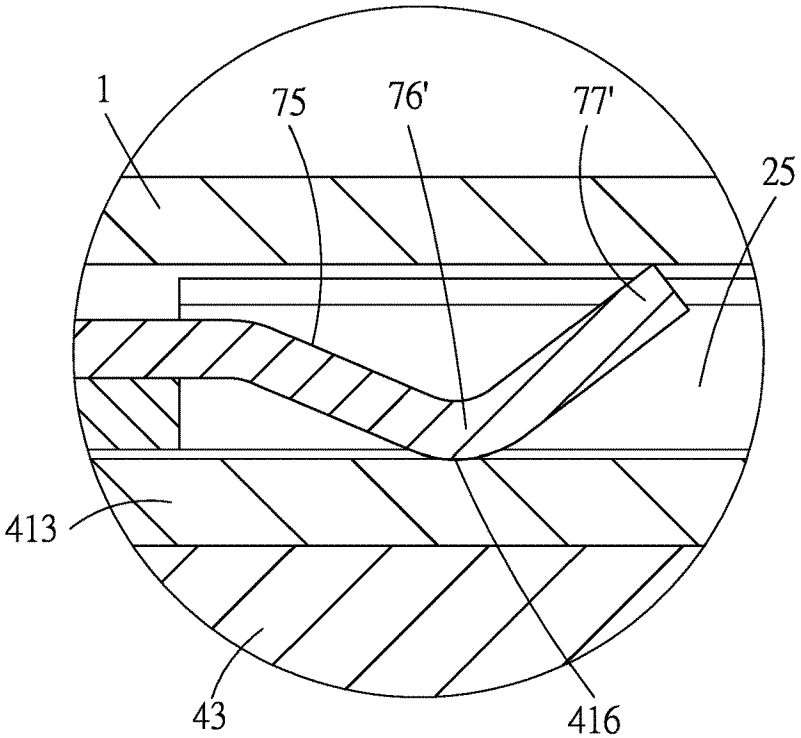
FIG. 10 illustrates an enlarged view of the portion A shown in FIG. 9.

Please refer to FIG. 2, FIGS. 4 to 6, and FIG. 8. FIG. 5 illustrates a perspective view of the abutting plates (EMI (Electro-Magnetic Interference) plates) 7 and the first plug terminals 41 of the electrical plug connector 100. FIG. 6 illustrates a front view of the abutting plates (EMI (Electro-Magnetic Interference) plates) 7 and the first plug terminals 41 of the electrical plug connector 100. In this embodiment, the abutting plates (EMI (Electro-Magnetic Interference) plates) 7 are respectively on the first assembling portion 21*a* and the second assembling portion 21*b*. Each of the abutting plates (EMI (Electro-Magnetic Interference) plates) 7 comprises a main body 71 and a plurality of elastic arms 75. Each of the elastic arms 75 comprises a terminal contact portion 76' and a shell contact portion 77'. The terminal contact portion 76' is extending toward the corresponding recessed hole 25 and in contact with the at least one ground terminal 413 of the first plug terminals 41 or the at least one ground terminal 513 of the second plug terminals 51. The shell contact portion 77' is in contact with the inner surface of the metallic shell 1. In this embodiment, the terminal contact portion 76' is downwardly extending below the corresponding recessed hole 25 from a rear portion of the corresponding elastic arm 75, the shell contact portion 77' is reversely bent from the corresponding terminal contact portion 76' and upwardly extending above the corresponding recessed hole 25, and the edge portion of the shell contact portion 77' is in contact with the inner surface of the metallic shell 1. Please refer to FIG. 10, from a lateral view of the terminal contact portion 76' and the shell contact portion 77', the terminal contact portion 76' and the shell contact portion 77' together form a V-shape profile.

Please refer to FIG. 2, FIGS. 4 to 6, and FIG. 8. In this embodiment, the front portion of the insulated housing 2 comprises three trapezoidal holes for mating with abutting portions 73 extending from a front portion of each of the main bodies 71, and the number of the abutting portions 73 corresponds to that of the trapezoidal holes. The abutting portions 73 are inserted into the insertion cavity 22. Therefore, when the electrical plug connector 100 is mated with an electrical receptacle connector, the electrical receptacle connector is in contact with and held by the abutting portions 73. Additionally, the slot 711 is formed on the front portion of each of the main bodies 71 and has a rectangular shape. The slots correspond to the terminal grooves 23. Therefore, the first flexible contact portions 415 and the second flexible contact portions 515 can be respectively deflected toward the slots 711 and not in contact with the abutting plates (EMI (Electro-Magnetic Interference) plates) 7 upon the electrical plug connector 100 is mated with an electrical receptacle connector.

Please refer to FIGS. 2 to 4. In this embodiment, the first combining block 43 is combined with the first body portions 416 of the first plug terminals 41 by insert-molding to form the first terminal module 4, and the second combining block 53 is combined with the second body portions 516 of the second plug terminals 51 by insert-molding to form the second terminal module 5. Next, the first terminal module 4 and the second terminal module 5 are respectively assembled to an upper portion and a lower portion of the central combining plate 31.

Please refer to FIGS. 2, 4, and 8. Accordingly, the assembly of the first terminal module 4, the grounding plate 3, and the second terminal module 5 is assembled with the insulated housing 2, so that the first combining block 43 and the second combining block 53 are positioned in the assembling recess 24, and the first flexible contact portions 415 and the second flexible contact portions 515 are inserted into and positioned in the insertion cavity 22.

Please refer to FIGS. 2, 5, and 9. In this embodiment, clamping plates 9 are assembled with two sides of the first combining block 43 and the second combining block 53, and the clamping plates 9 can be provided for clamping the side portions of the circuit board for positioning the circuit board.

Figure 11:
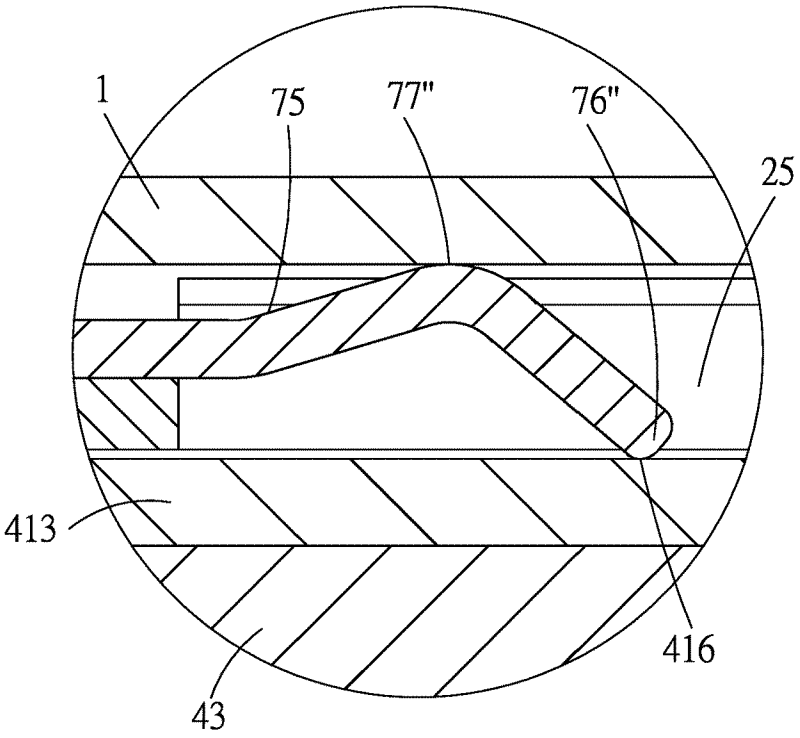
FIG. 11 illustrates an enlarged view of an electrical plug connector according to a second embodiment of the instant disclosure.

Please refer to FIG. 11. FIG. 11 illustrates an enlarged view of an electrical plug connector 100 according to a second embodiment of the instant disclosure. In this embodiment, the structure of the elastic arm 75 is different from the first embodiment. In this embodiment, the shell contact portion 77" is upwardly extending above the corresponding recessed hole 25 from a rear portion of the corresponding elastic arm 75, and the terminal contact portion 76' is reversely bent from the corresponding shell contact portion 77" and downwardly extending below the corresponding recessed hole 25 From a lateral view of the terminal contact portion 76" and the shell contact portion 77", the terminal contact portion 76" and the shell contact portion 77" together form a reversed V-shape profile.

When the metallic shell 1 is assembled out of the insulated housing 2, the inner surface of the metallic shell 1 is in contact with the shell contact portions 77" of the abutting plates (EMI (Electro-Magnetic Interference) plates) 7. For each of the abutting plates (EMI (Electro-Magnetic Interference) plates) 7, the terminal contact portion 76" and the shell contact portion 77" form a reversed V-shape profile. Hence, when the metallic shell 1 is assembled out of the insulated housing 2, the metallic shell 1 pushes the shell contact portions 77" to move toward the recessed holes 25. Therefore, the metallic shell 1 can be assembled with the insulated housing 2 conveniently, and assembling the metallic shell 1 with the insulated housing 2 would not be interfered by the shell contact portions 77".

As above, the elastic arms are extending from the rear portion of the abutting plates (EMI (Electro-Magnetic Interference) plates), and each of the elastic arms comprises a terminal contact portion and a shell contact portion. The terminal contact portions are provided for being in contact with the ground terminals of the plug terminals. The shell contact portions are provided for being in contact with the metallic shell. The shell contact portions are in contact with the metallic shell for performing conduction and grounding through the contacts between the terminal contact portions and the ground terminals of the plug terminals in a short-distance manner. Therefore, the high frequency features of the connector can be optimized effectively and the resonant problems of the connector can be improved.

Furthermore, the first plug terminals and the second plug terminals are arranged upside down, and the pin-assignment of the first flexible contact portions is left-right reversal with respect to that of the second flexible contact portions. Accordingly, the electrical plug connector can have a 180 degree symmetrical, dual or double orientation design and pin assignments which enables the electrical plug connector to be mated with a corresponding receptacle connector in either of two intuitive orientations, i.e. in either upside-up or upside-down directions. Therefore, when the electrical plug connector is inserted into the electrical receptacle connector with a first orientation, the first flexible contact portions are in contact with upper-row receptacle terminals of the electrical receptacle connector. Conversely, when the electrical plug connector is inserted into the electrical receptacle connector with a second orientation, the second flexible contact portions are in contact with the upper-row receptacle terminals of the electrical receptacle connector. Note that, the inserting orientation of the electrical plug connector is not limited by the electrical receptacle connector.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical plug connector, comprising:

a metallic shell comprising a receiving cavity;

an insulated housing received in the receiving cavity, wherein the insulated housing comprises a first assembling portion and a second assembling portion corresponding to the first assembling portion, an insertion cavity is formed between the first assembling portion and the second assembling portion, a plurality of terminal grooves is formed on the first assembling portion and the second assembling portion, and the terminal grooves are communicating with the insertion cavity, an opening of the insertion cavity is at one of two sides of the insulated housing, and an assembling recess is recessed from the other side of the insulated housing, a plurality of recessed holes is formed on the first assembling portion and the second assembling portion, the recessed holes are communicating with the assembling recess;

a first terminal module comprising a plurality of first plug terminals and a first combining block, wherein the first combining block is on the assembling recess, one end of each of the first plug terminals is extending from the insertion cavity toward the corresponding terminal groove of the first assembling portion;

a second terminal module comprising a plurality of second plug terminals and a second combining block, wherein the second combining block is on the assembling recess and combined with the first combining block, one end of each of the second plug terminals is extending from the insertion cavity toward the corresponding terminal groove of the second assembling portion; and a plurality of abutting plates respectively on the first assembling portion and the second assembling portion, wherein each of the abutting plates comprises a main body and at least one elastic arm respectively outwardly extending from a rear portion of the main body, each elastic arm comprises a terminal contact portion and a shell contact portion, the terminal contact portion is extending toward the corresponding recessed hole and in contact with the at least one first ground terminal of the first plug terminals or the at least one second ground terminal of the second plug terminals, and the shell contact portion is in contact with an inner surface of the metallic shell.

2. The electrical plug connector according to claim 1, wherein each of the terminal contact portions is downwardly extending below the corresponding recessed hole from a rear portion of the corresponding elastic arm, each of the shell contact portions is reversely bent from the corresponding terminal contact portion and upwardly extending above the corresponding recessed hole, and an edge portion of each of the shell contact portions is in contact with the inner surface of the metallic shell.

3. The electrical plug connector according to claim 2, wherein after the inner surface of the metallic shell is in contact with the shell contact portions, the terminal contact portions are respectively in contact with the at least one first ground terminal and the at least one second ground terminal.

4. The electrical plug connector according to claim 2, wherein the edge portion of each of the shell contact portions is extending out of the corresponding recessed hole for being in contact with the inner surface of the metallic shell.

5. The electrical plug connector according to claim 1, wherein each of the shell contact portions is upwardly extending above the corresponding recessed hole from a rear portion of the corresponding elastic arm, each of the terminal contact portions is reversely bent from the corresponding shell contact portion and downwardly extending below the corresponding recessed hole.

6. The electrical plug connector according to claim 1, wherein each of the first plug terminals comprises a first flexible contact portion, a first body portion, and a first tail portion, each of the first body portions is held in the first combining block, each of the first flexible contact portions is extending forward from the first body portion in the rear-to-front direction and held in the corresponding terminal groove of the first combining block, each of the first tail portions is extending backward from the first body portion in the front-to-rear direction and extending out of the first combining block.

7. The electrical plug connector according to claim 6, wherein a surface of each of the first body portions is exposed out of a surface of the first combining block and in contact with the terminal contact portion.

8. The electrical plug connector according to claim 1, wherein each of the second plug terminals comprises a second flexible contact portion, a second body portion, and a second tail portion, each of the second body portions is held in the second combining block, each of the second flexible contact portions is extending forward from the second body portion in the rear-to-front direction and held in the corresponding terminal groove of the second combining block, each of the second tail portions is extending backward from the second body portion in the front-to-rear direction and extending out of the second combining block.

9. The electrical plug connector according to claim 8, wherein a surface of each of the second body portions is exposed out of a surface of the second combining block and in contact with the terminal contact portion.

10. The electrical plug connector according to claim 1, further comprising a plurality of Mylar sheets, wherein each of the Mylar sheets is between the corresponding abutting plate and the metallic shell.

11. The electrical plug connector according to claim 1, wherein each of the abutting plates further comprises a slot, a plurality of abutting portions, and a plurality of hook portions, the slot is formed on the main body and corresponding to the terminal grooves, each of the abutting portions is outwardly extending from a front end of the main body toward the insertion cavity, the hook portions are extending and bent from two sides of the main body and respectively engaged with the first assembling portion and the second assembling portion.

* * * * *